US011852086B2

(12) United States Patent
Suzuki et al.

(10) Patent No.: US 11,852,086 B2
(45) Date of Patent: Dec. 26, 2023

(54) CONTROLLER AND CONTROL METHOD FOR ENGINE

(71) Applicant: TOYOTA JIDOSHA KABUSHIKI KAISHA, Aichi-ken (JP)

(72) Inventors: Yuki Suzuki, Kariya (JP); Tomihisa Tsuchiya, Toyota (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 18/186,208

(22) Filed: Mar. 20, 2023

(65) Prior Publication Data

US 2023/0304452 A1 Sep. 28, 2023

(30) Foreign Application Priority Data

Mar. 25, 2022 (JP) ..... 2022-049635

(51) Int. Cl.
*F02D 41/00* (2006.01)
*F02M 25/028* (2006.01)
*F02M 25/025* (2006.01)

(52) U.S. Cl.
CPC ..... *F02D 41/0025* (2013.01); *F02M 25/025* (2013.01); *F02M 25/028* (2013.01)

(58) Field of Classification Search
CPC . F02D 41/0025; F02M 25/025; F02M 25/028
USPC ..... 123/25 A, 25 J, 25 L, 25 M, 308, 432
See application file for complete search history.

(56) References Cited

U.S. PATENT DOCUMENTS 4,640,234 A * 2/1987 Olsson ..... F02D 19/12 123/308
6,415,745 B1 * 7/2002 Hellen ..... F02B 47/02 123/25 R
7,647,916 B2 * 1/2010 Leone ..... F02M 25/0227 123/25 Q
9,752,497 B2 * 9/2017 Yacoub ..... F02M 25/0227
2007/0215110 A1 * 9/2007 Stein ..... F02D 19/0628 123/406.47
2018/0066599 A1 3/2018 Narahara et al.

FOREIGN PATENT DOCUMENTS

JP 2017-201138 A 11/2017
JP 2017-218994 A 12/2017
JP 2018-40260 A 3/2018

* cited by examiner

*Primary Examiner* — Erick R Solis
(74) *Attorney, Agent, or Firm* — HAUPTMAN HAM, LLP

(57) ABSTRACT

An engine includes water injection valves that inject water to intake ports connected to a cylinder. A controller for the engine is configured to selectively execute, for each of the intake ports, a synchronous injection that causes the water injection valve to inject water only during a valve opening period of the intake valve and an asynchronous injection that causes the water injection valve to inject water during a valve closing period of the intake valve. The controller is configured to perform, when executing a synchronous/asynchronous concurrent injection in which the intake ports includes an intake port in which the synchronous injection is executed and an intake port in which the asynchronous injection is executed, a switching process of switching the intake port in which the asynchronous injection is executed.

7 Claims, 4 Drawing Sheets

CONTROLLER AND CONTROL METHOD FOR ENGINE

RELATED APPLICATIONS

The present application claims priority of Japanese Application Number 2022-049635 filed on Mar. 25, 2022, the disclosure of which is hereby incorporated by reference herein in its entirety.

BACKGROUND

1. Field

The present disclosure relates to a controller and a control method for an engine that includes a water injection valve for injecting water into intake air.

2. Description of Related Art

Japanese Laid-Open Patent Publication No. 2017-218994 discloses an engine that includes a water injection valve for injecting water into intake air.

In such an engine, some of the water injected into the intake air collects on the wall surface of the intake port. The amount of water collected on the wall surface of the intake port may increase as the water injection is repeatedly executed. In such a case, water droplets grow in the intake port. The grown large water droplets may flow into the cylinder.

Even if water droplets flow into the cylinder from the intake port, the water droplets evaporate in the cylinder if the water droplets are small. However, when large water droplets flow into the cylinder, the water droplets do not completely evaporate in the cylinder, but flow into the crankcase. The water droplets flowing into the crankcase may be mixed with the engine oil to emulsify the engine oil, or may evaporate to increase the internal pressure of the crankcase.

SUMMARY

In one general aspect, a controller for an engine is provided. The engine includes a cylinder, intake ports connected to the cylinder, intake valves, and water injection valves. The intake valves respectively correspond to the intake ports. Each of the intake valves is configured to selectively allow for and block connection between the corresponding one of the intake ports and the cylinder. The water injection valves are installed in the respective intake ports. Each of the water injection valves is configured to inject water to the corresponding one of the intake ports. The controller includes processing circuitry that is configured to selectively execute, for each of the intake ports, a synchronous injection that causes the corresponding one of the water injection valves to inject water only during a valve opening period of the corresponding one of the intake valves and an asynchronous injection that causes the corresponding one of the water injection valves to inject water during a valve closing period of the corresponding one of the intake valves. The processing circuitry is configured to perform, when executing a synchronous/asynchronous concurrent injection in which the intake ports includes an intake port in which the synchronous injection is executed and an intake port in which the asynchronous injection is executed, a switching process of switching the intake port in which the asynchronous injection is executed.

In another general aspect, a method for controlling an engine is provided. The engine includes a cylinder, intake ports connected to the cylinder, intake valves, and water injection valves. The intake valves respectively correspond to the intake ports. Each of the intake valves is configured to selectively allow for and block connection between the corresponding one of the intake ports and the cylinder. The water injection valves are installed in the respective intake ports. Each of the water injection valves is configured to inject water to the corresponding one of the intake ports. The method includes: selectively executing, for each of the intake ports, a synchronous injection that causes the corresponding one of the water injection valves to inject water only during a valve opening period of the corresponding one of the intake valves and an asynchronous injection that causes the corresponding one of the water injection valves to inject water during a valve closing period of the corresponding one of the intake valves; executing a synchronous/asynchronous concurrent injection in which the intake ports includes an intake port in which the synchronous injection is executed and an intake port in which the asynchronous injection is executed; and when executing the synchronous/asynchronous concurrent injection, executing a switching process of switching the intake port in which the asynchronous injection is executed.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, except for operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

First Embodiment

Figure 1:
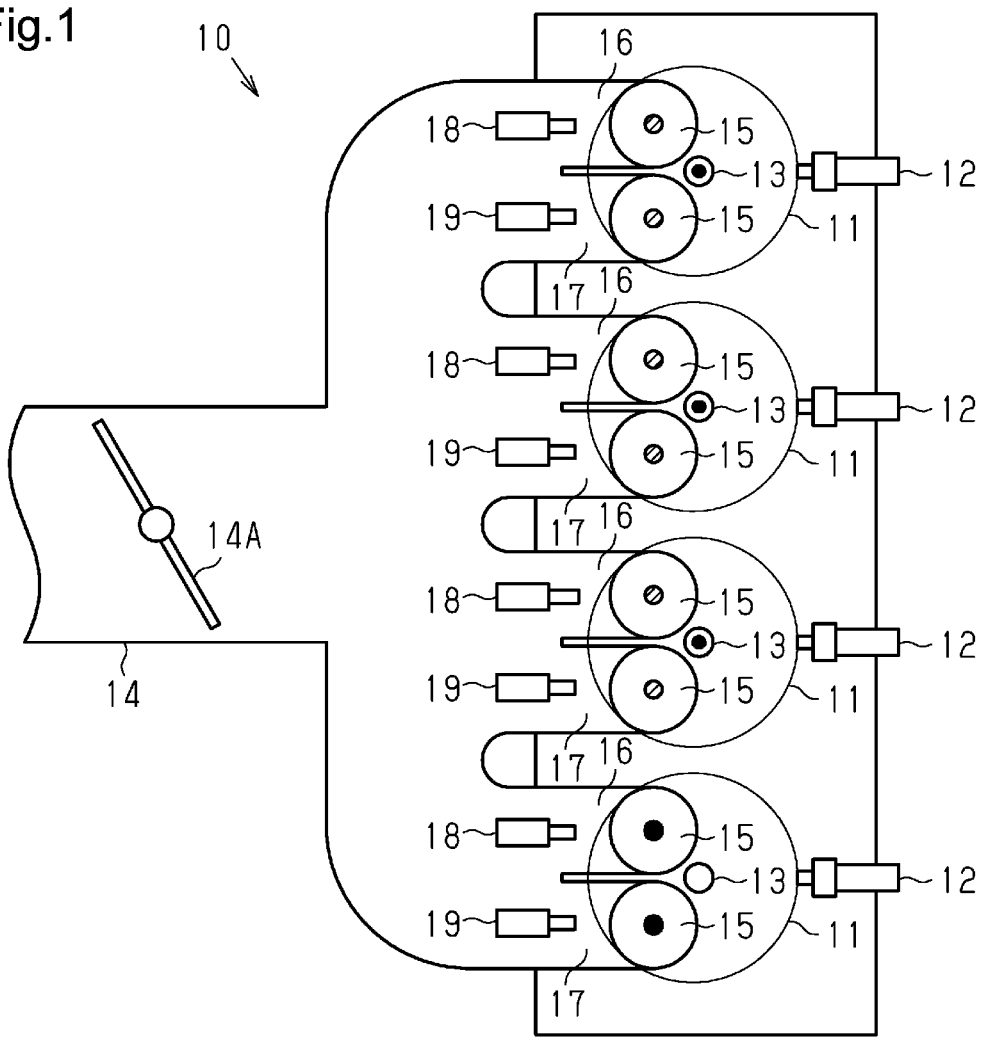
FIG. 1 is a diagram schematically showing a configuration of an intake system of an engine according to a first embodiment.
Figure 2:
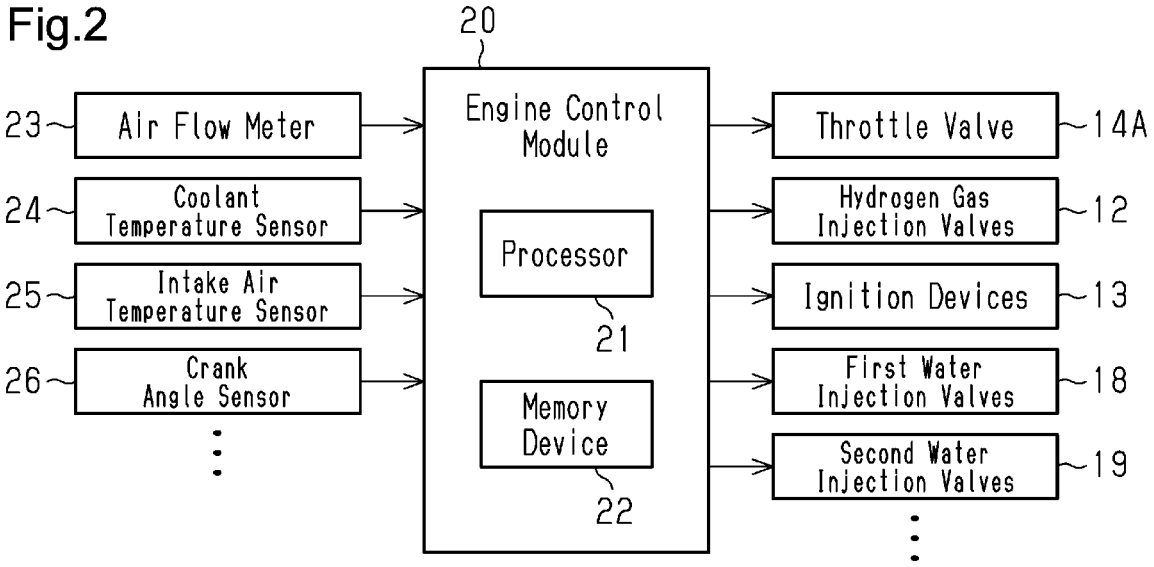
FIG. 2 is a diagram schematically showing a configuration of a controller employed in the engine of FIG. 1.

A first embodiment of the present disclosure will now be described with reference to FIGS. 1 to 3.

<Configuration of Intake System of Engine 10>

First, the configuration of the intake system of the engine 10 will be described with reference to FIG. 1. The engine 10 is a hydrogen fuel engine that uses hydrogen gas as fuel. The engine 10 includes multiple (four in the present embodiment) cylinders 11. Each cylinder 11 is provided with a hydrogen gas injection valve 12 and an ignition device 13. The hydrogen gas injection valve 12 injects hydrogen gas into the corresponding cylinder 11. The ignition device 13 causes a spark discharge to ignite hydrogen gas injected into the cylinder 11 by the hydrogen gas injection valve 12.

An intake passage 14 of the engine 10 incorporates a throttle valve 14A. Each cylinder 11 is connected to the intake passage 14 via two intake ports: a first intake port 16 and a second intake port 17. Intake valves 15 are respectively provided at a joint portion between each first intake port 16 and the corresponding cylinder 11 and a joint portion between each second intake port 17 and the corresponding cylinder 11. The intake valves 15 each operate in conjunction with rotation of the crankshaft of the engine 10 to open and close the corresponding one of intake ports 16, 17. That is, the intake valves 15 each selectively allows for and blocks connection between the corresponding one of the intake ports 16, 17 and the cylinder 11. Each cylinder 11 is provided with two water injection valves: a first water injection valve 18 and a second water injection valve 19. The first water injection valve 18 injects water into the first intake port 16. The second water injection valve 19 injects water into the second intake port 17.

<Configuration of Engine Controller>

Next, the configuration of a controller for the engine 10 will be described with reference to FIG. 2. The controller includes an engine control module (ECM) 20. The ECM 20 is an electronic control unit or processing circuitry that includes a processor 21 and a memory device 22. The memory device 22 stores programs and data used to control the engine 10. The processor 21 executes various processes related to control of the engine 10 by reading and executing programs stored in the memory device 22.

The ECM 20 is connected to various types of sensor that acquire the operating state of the engine 10. The sensors connected to the ECM 20 include an air flow meter 23, a coolant temperature sensor 24, an intake air temperature sensor 25, and a crank angle sensor 26. The air flow meter 23 detects the flow rate of intake air flow rate in the intake passage 14. The coolant temperature sensor 24 detects the temperature of coolant of the engine 10. The intake air temperature sensor 25 detects the temperature of intake air in the intake passage 14. The crank angle sensor 26 detects the rotational phase of the crankshaft, which is an output shaft of the engine 10. The ECM 20 obtains an engine rotation speed, which is a rotation speed of the engine 10, based on a detection result of the crank angle sensor 26. Further, the ECM 20 obtains an engine load factor, which is a filling factor of intake air of each of the cylinders 11, based on the intake air flow rate, the engine rotation speed, and the like.

Based on the detection results of these sensors, the ECM 20 performs an engine control that includes a hydrogen gas injection control for the hydrogen gas injection valves 12, an ignition timing control for the ignition devices 13, and an opening degree control for the throttle valve 14A. As part of the engine control, the ECM 20 performs a water injection control for each first water injection valve 18 and each second water injection valve 19.

<Water Injection Control>

Next, the water injection control, which is performed by the ECM 20, will be described. In the case of an engine using liquid fuel such as gasoline, the inside of the cylinder is cooled by latent heat of vaporization of fuel. In contrast, in the case of the engine 10, in which hydrogen gas is injected, cooling by latent heat of vaporization of fuel is not performed. Thus, the temperature inside the cylinders 11 is higher than that in the case of an engine using liquid fuel. Accordingly, abnormal combustion such as pre-ignition is likely to occur. Therefore, the engine 10 cools the inside of the cylinders 11 by using latent heat of vaporization of the water injected by the first water injection valves 18 and the second water injection valves 19.

Figure 3:
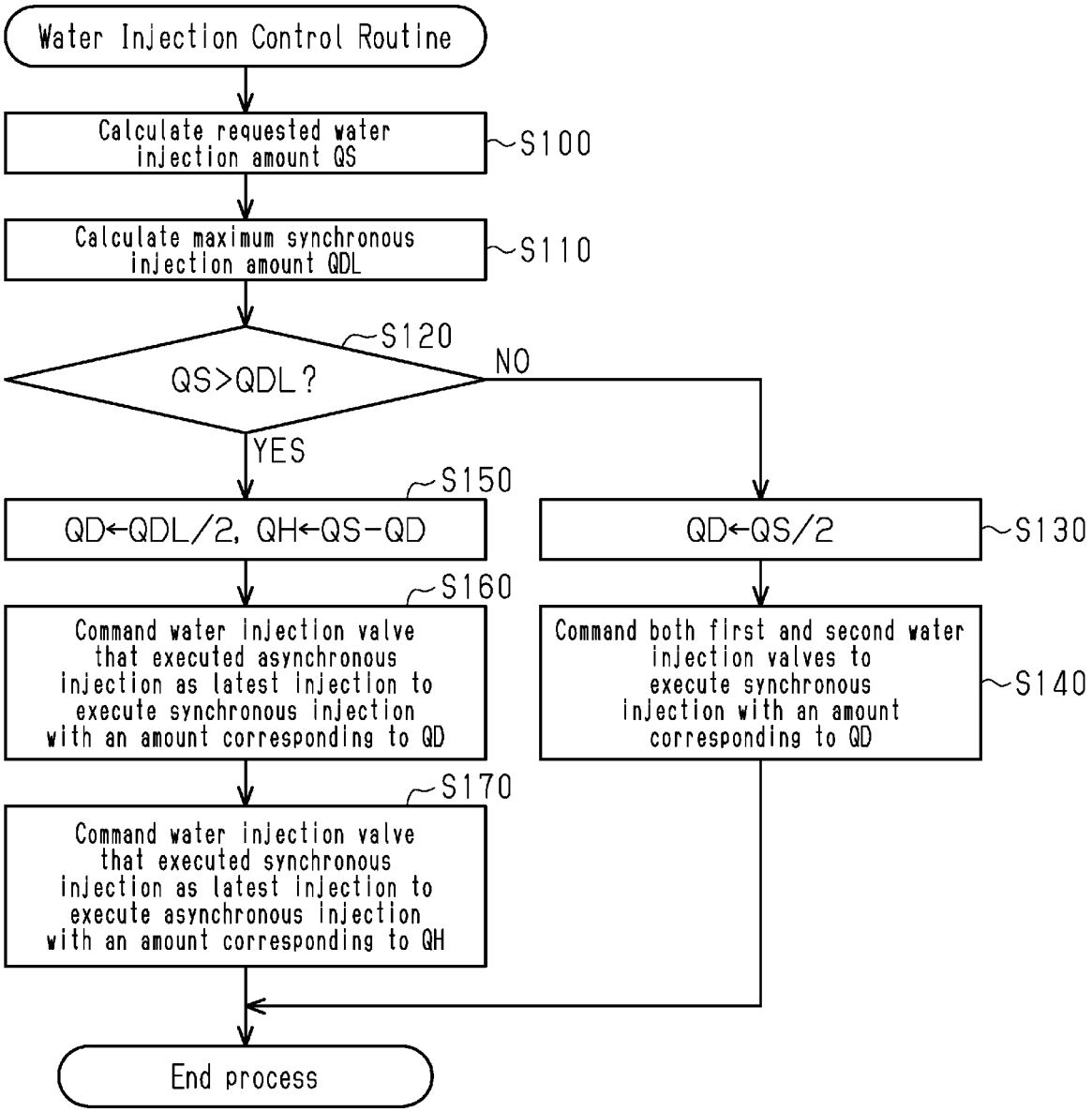
FIG. 3 is a flowchart showing a procedure of a water injection control routine executed by the controller of FIG. 2.

FIG. 3 is a flowchart of a water injection control routine executed by the ECM 20. The ECM 20 repeatedly executes the routine at each specified control cycle during the operation of the engine 10. The water injection control routine is executed, for example, for each cylinder 11 in every combustion cycle of the engine 10.

When this routine is started, the ECM 20 first calculates a requested water injection amount QS based on the operating state of the engine 10 in step S100. In the present embodiment, the ECM 20 calculates the requested water injection amount QS based on the engine rotation speed and the engine load factor. The ECM 20 calculates, as a value of the requested water injection amount QS, an amount of water injection required to cool the inside of each cylinder 11 to a temperature at which abnormal combustion is avoided. In a high rotation speed and high load operation, a relatively large amount of heat is generated per unit time by combustion in each cylinder 11. The ECM 20 calculates a greater value of the requested water injection amount QS during a high rotation speed and high load operation than during a low rotation speed and low load operation. The requested water injection amount QS represents a requested value of a total water injection amount, which is the sum of the water injection amounts for the first intake port 16 and the second intake port 17. The requested water injection amount QS is a total water injection amount required during one combustion cycle of the engine 10.

Subsequently, in step S110, the ECM 20 calculates the value of a maximum synchronous injection amount QDL based on the engine rotation speed. The maximum synchronous injection amount QDL represents the maximum value of the amount of water that can be injected during the valve opening period of the intake valves 15 in each cylinder 11. Each cylinder 11 is provided with two water injection valves: the first water injection valve 18 and the second water injection valve 19. Therefore, the maximum synchronous injection amount QDL is a value obtained by adding the maximum value of the amount of water that can be injected by the first water injection valve 18 during the valve opening period of the intake valves 15 and the maximum value of the amount of water that can be injected by the second water injection valve 19 during the valve opening period of the intake valves 15. The valve opening period of the intake valves 15 is shortened as the engine rotation speed increases. Therefore, the ECM 20 calculates a smaller amount as the value of the maximum synchronous injection amount QDL as the engine rotation speed increases. The maximum synchronous injection amount QDL thus calculated represents the maximum value of the total water injection amount obtained when the synchronous injection is executed in both the first intake port 16 and the second intake port 17 during one combustion cycle of the engine 10. The synchronous injection is water injection executed only during the valve opening period of the intake valves 15. More strictly, the synchronous injection is water injection that is started end ended within the valve opening period of the intake valves 15.

Next, in step S120, the ECM 20 determines whether the requested water injection amount QS exceeds the maximum synchronous injection amount QDL. When the requested water injection amount QS is less than or equal to the maximum synchronous injection amount QDL (S120: NO), the ECM 20 advances the process to step S130. In step S130, the ECM 20 calculates one half of the requested water injection amount QS as a synchronous injection amount command value QD. Subsequently, in step S140, the ECM 20 commands the first and second water injection valves 18 and 19 to execute synchronous injection with an amount equal to the synchronous injection amount command value QD. After the process of step S140, the ECM 20 ends the current process of this routine.

When the requested water injection amount QS exceeds the maximum synchronous injection amount QDL (S120: YES), the ECM 20 advances the process to step S150. In step S150, the ECM 20 calculates one half of the maximum synchronous injection amount QDL as the synchronous injection amount command value QD. The synchronous injection amount command value QD at this time is set to the maximum value of the amount of water that can be injected to a single intake port by the synchronous injection. That is, the synchronous injection amount command value QD at this time is calculated as the maximum value of the amount of water that can be injected by each of the first water injection valve 18 and the second water injection valve 19 alone within the valve opening period of the intake valves 15. In step S150, the ECM 20 calculates a value obtained by subtracting the synchronous injection amount command value QD from the requested water injection amount QS as an asynchronous injection amount command value QH. In the subsequent step S160, the ECM 20 commands a water injection valve that executed the asynchronous injection as the latest injection to execute the synchronous injection with an amount equal to the synchronous injection amount command value QD. Further, in step S170, the ECM 20 commands a water injection valve that executed synchronous injection as the latest injection to execute the asynchronous injection with an amount equal to the asynchronous injection amount command value QH. The asynchronous injection is water injection executed during the valve closing period of the intake valves 15. In the present embodiment, water injection by the asynchronous injection is executed during the exhaust stroke, which is before the intake valves 15 are opened.

In the processes of steps S160 and S170, both the first and second water injection valves 18 and 19 may have executed the synchronous injection as the latest injection. In such a case, in step S160, the ECM 20 commands a predetermined one of the first and second water injection valves 18 and 19 to execute the synchronous injection with an amount equal to the synchronous injection amount command value QD. Then, in step S170, the ECM 20 commands the other water injection valve to execute the asynchronous injection with an amount equal to the asynchronous injection amount command value QH.

In the present embodiment, the processes of steps S160 and S170 correspond to a switching process. Further, the process of step S100 corresponds to a first calculation process, and the process of step S110 corresponds to a second calculation process.

Operation and Advantages of Embodiment

Operation and advantages of the present embodiment will now be described.

The ECM 20 performs the water injection control such that the first water injection valve 18 and the second water injection valve 19 inject an amount of water equal to the requested water injection amount QS, which is calculated based on the operating state of the engine 10. At this time, if the requested water injection amount QS is less than or equal to the maximum synchronous injection amount QDL, an amount of equal to the requested water injection amount QS can be injected by the synchronous injection alone, in which water is injected during the valve opening period of the intake valves 15. If the requested water injection amount QS exceeds the maximum synchronous injection amount QDL, an amount of water equal to the requested water injection amount QS cannot be injected by the synchronous injection alone. In this case, it is necessary to execute the asynchronous injection, in which water is injected while the intake valves 15 are closed.

In the synchronous injection, water injection is executed in a state in which the intake ports are open to the cylinder 11. In this case, some of the injected water directly flows into the cylinder 11. In addition, water is injected into the flow of intake air from the intake ports toward the cylinder 11. Therefore, the synchronous injection restricts water from collecting on the wall surfaces of the intake ports. In the asynchronous injection, the water injection is executed in a state in which the intake ports are disconnected from the cylinder 11. Therefore, by the asynchronous injection, water is more likely to collect on the wall surfaces of the intake ports than by the synchronous injection. If the asynchronous injection is continued in the same intake port, the amount of water collecting on the wall surface of that intake port gradually increases. As the amount of collected water increases, the water droplets collecting on the wall surface grow. If such grown and large water droplets flow into the cylinder, the water droplets may be mixed with the engine oil to cause clouding of the engine oil or an increase in the internal pressure of the crankcase due to the vapor pressure.

However, when the requested water injection amount QS is less than or equal to the maximum synchronous injection amount QDL, the ECM 20 commands both the first water injection valve 18 and the second water injection valve 19 to execute synchronous injection with half of the requested water injection amount QS. That is, when the requested water injection amount QS can be injected by the synchronous injection, the ECM 20 executes the water injection by the synchronous injection alone.

When the requested water injection amount QS exceeds the maximum synchronous injection amount QDL, the ECM 20 commands one of the first water injection valve 18 and the second water injection valve 19 to execute the synchronous injection with an amount equal to one half of the maximum synchronous injection amount QDL. The ECM 20 commands the other water injection valve to execute the asynchronous injection with the remaining amount. In the following description, a mode of water injection in a manner in which one of the first water injection valve 18 and the second water injection valve 19 executes the synchronous injection and the other executes the asynchronous injection in each cylinder 11 during one combustion cycle of the engine 10 will be referred to as a synchronous/asynchronous concurrent injection. In the synchronous/asynchronous concurrent injection, the intake ports corresponding to each cylinder 11 include, during one combustion cycle of the engine 10, at least one intake port in which the synchronous injection is executed and at least one intake port in which the asynchronous injection is executed.

In the synchronous/asynchronous concurrent injection, the ECM 20 commands the water injection valve that executed the asynchronous injection as the latest injection to execute the synchronous injection, and commands the water injection valve that executed the synchronous injection as the latest injection to execute the asynchronous injection. That is, when executing the synchronous/asynchronous concurrent injection, the ECM 20 alternately switches between the water injection valve that executes the asynchronous injection between the first water injection valve 18 and the second water injection valve 19 for each injection. For example, a water injection valve that executed the asynchronous injection in the previous combustion cycle executes the synchronous injection in the current combustion cycle, and a water injection valve that executed the synchronous injection in the previous combustion cycle executes the asynchronous injection in the current combustion cycle. As a result, the asynchronous injection, with which the amount of water collecting on the wall surfaces of the intake ports is more likely to increase than with the synchronous injection, is not continued in the same intake port.

The engine controller of the present embodiment has the following advantages.

(1) When executing the synchronous/asynchronous concurrent injection, the ECM 20 executes the switching process to alternately switch the water injection valve that executes the asynchronous injection between the first water injection valve 18 and the second water injection valve 19. This restricts water from collecting on the wall surfaces of the intake ports.

(2) The amount of water collecting on the wall surfaces of the intake ports is restricted from increasing. This suppresses clouding of the engine oil due to mixed water and an increase in the internal pressure of the crankcase due to generation of water vapor.

(3) The water injection valve that executes the synchronous injection and the water injection valve that executes the asynchronous injection are switched for each injection. Thus, the amount of collected water is prevented from being concentrated to one of the first intake port 16 or the second intake port 17.

(4) If the requested water injection amount QS does not exceed the maximum synchronous injection amount QDL, water injection is executed by the synchronous injection alone. This reduces the frequency of the asynchronous injection, with which the amount of water collecting on the wall surfaces of the intake ports is likely to increase.

(5) The synchronous injection amount command value QD in the synchronous/asynchronous concurrent injection is set to the maximum value of the amount of water that a single water injection valve can inject by the synchronous injection alone. This reduces the amount of water injection by the asynchronous injection.

Second Embodiment

A second embodiment of the present disclosure will now be described with reference to FIG. 4. Like or the same reference numerals are given to those components that are like or the same as the corresponding components of the first embodiment, and the detailed description will be omitted. The controller according to the present embodiment has the same configuration as the controller according to the first embodiment except that a part of the process of the water injection control routine is different.

Figure 4:
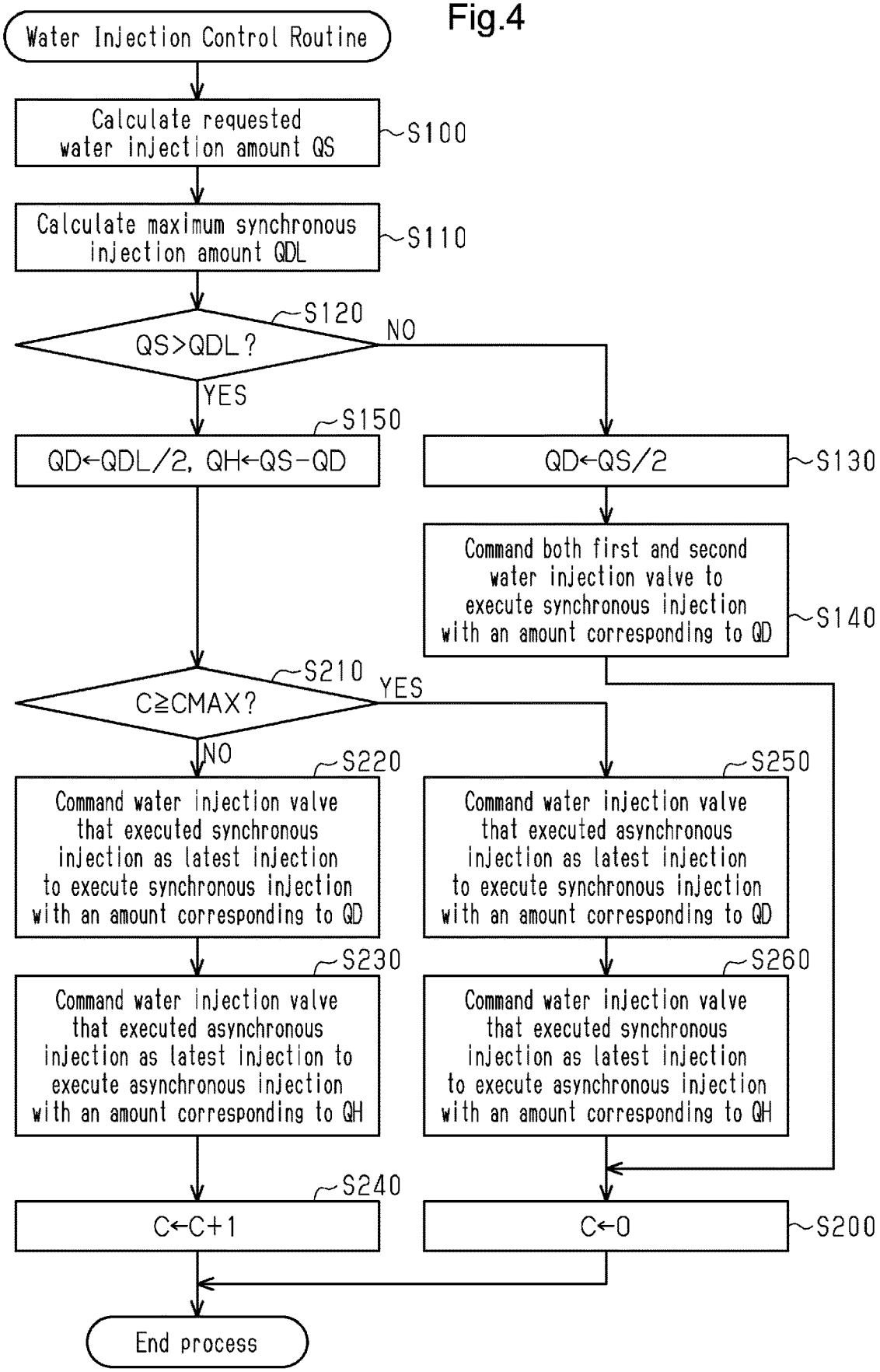
FIG. 4 is a flowchart showing a procedure of a water injection control routine executed by a controller according to a second embodiment.

FIG. 4 shows a flowchart of a water injection control routine executed by the controller of the present embodiment instead of the control routine of FIG. 3 in the first embodiment. The processes of steps S100 to S150 in the flowchart of FIG. 4 are common to the those in FIG. 3. That is, in the present embodiment, when the requested water injection amount QS is less than or equal to the maximum synchronous injection amount QDL (S120: NO), the ECM 20 calculates one half of the requested water injection amount QS as the synchronous injection amount command value QD in step S130. Subsequently, in step S140, the ECM 20 commands the first and second water injection valves 18 and 19 to execute synchronous injection with an amount equal to the synchronous injection amount command value QD. In the present embodiment, the ECM 20 further resets the value of an asynchronous injection count C to 0 in step S200, and then ends the current processing of this routine. The asynchronous injection count C indicates the number of times of consecutive times the asynchronous injections has been executed in the same intake port.

Also, in the present embodiment, if the requested water injection amount QS exceeds the maximum synchronous injection amount QDL (S120: YES), the ECM 20 calculates one half of the maximum synchronous injection amount QDL as the synchronous injection amount command value QD in step S150. In step S150, the ECM 20 calculates a value obtained by subtracting the synchronous injection amount command value QD from the requested water injection amount QS as an asynchronous injection amount command value QH. In the present embodiment, the ECM 20 determines, in the subsequent step S210, whether the value of the asynchronous injection count C is greater than or equal to a specified threshold CMAX. The threshold CMAX is set to an integer greater than 1 in advance.

When the value of the asynchronous injection count C is less than the threshold CMAX (S210: NO), the ECM 20 commands, in step S220, the water injection valve that executed the synchronous injection as the latest injection to execute the synchronous injection with an amount equal to the synchronous injection amount command value QD. Further, in step S230, the ECM 20 commands the water injection valve that executed the asynchronous injection as the latest injection to execute asynchronous injection with an amount equal to the asynchronous injection amount command value QH. That is, the ECM 20 continuously executes the synchronous injection to the intake port in which the synchronous injection was executed as the latest injection. Also, the ECM 20 continuously executes the asynchronous injection to the intake port in which the asynchronous injection was executed as the latest injection. The ECM 20 increments the value of the asynchronous injection count C in step S240, and then ends the current processing of this routine.

When the value of the asynchronous injection count C is greater than or equal to the threshold CMAX (S210: YES), the ECM 20, in step S250, commands the water injection valve that executed the asynchronous injection as the latest injection to execute the synchronous injection with an amount equal to the synchronous injection amount command value QD. Further, in step S260, the ECM 20 commands a water injection valve that executed synchronous injection as the latest injection to execute the asynchronous injection with an amount equal to the asynchronous injection amount command value QH. That is, the ECM 20 switches between the intake port in which the synchronous injection is executed and the intake port in which the asynchronous injection is executed. The ECM 20 then resets the value of an asynchronous injection count C to 0 in step S200, and then ends the current processing of this routine. In the present embodiment, the processes of steps S200 to S260 in the water injection control routine in FIG. 4 correspond to the switching process.

Operation and Advantages of Embodiment

The controller of the present embodiment switches the intake port in which the asynchronous injection is executed each time the number of times of consecutive executions of the asynchronous injection in the same intake port reaches the threshold value CMAX, that is, each time the number of times of consecutive executions reaches a specified number of times. This configuration prevents the asynchronous injection from being continued in the same intake port. The present embodiment thus achieves the same advantages as the first embodiment.

Third Embodiment

A third embodiment of the present disclosure will now be described with reference to FIG. 5. Like or the same reference numerals are given to those components that are like or the same as the corresponding components of the first embodiment, and the detailed description will be omitted. The controller according to the present embodiment has the same configuration as the controller according to the first embodiment except that a part of the process of the water injection control routine is different.

Figure 5:
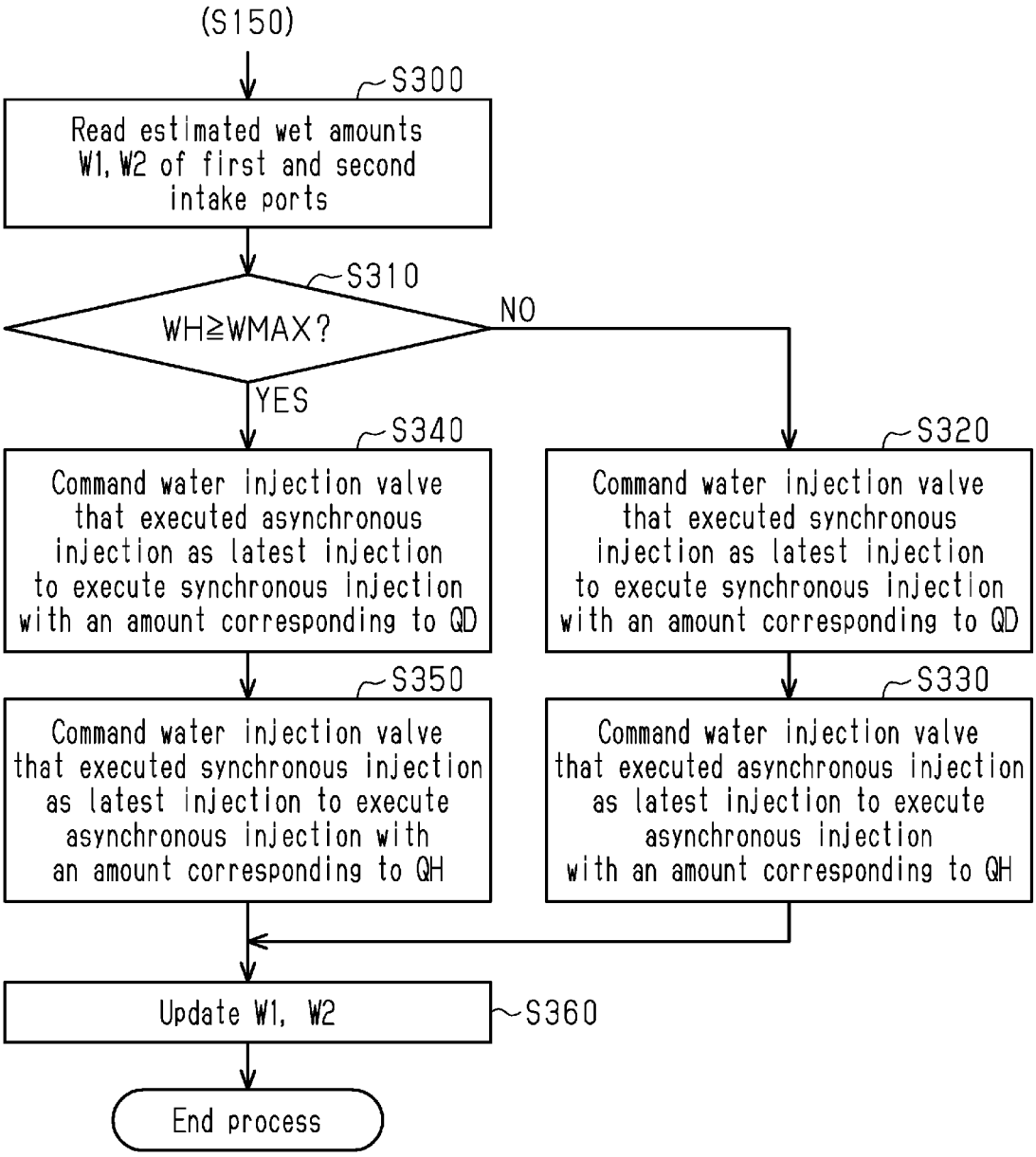
FIG. 5 is a flowchart showing a part of a procedure of a water injection control routine executed by a controller according to a third embodiment.

FIG. 5 shows a part of the water injection control routine according to the present embodiment that is different from the first embodiment. In the water injection control routine of the present embodiment, the processes after step S150 in FIG. 3 are replaced. The series of processes shown in FIG. 5 is executed subsequently to the process of step S150 in FIG. 3. When the requested water injection amount QS exceeds the maximum synchronous injection amount QDL (S120: YES), the ECM 20 of the present embodiment calculates the synchronous injection amount command value QD and the asynchronous injection amount command value QH in step S150, and then proceeds to the process of FIG. 5.

First, in step S300 of FIG. 5, the ECM 20 reads a value of an estimated wet amount W1 of the first intake port 16 and a value of an estimated wet amount W2 of the second intake port 17 recorded in the memory device 22. The estimated wet amounts W1, W2 are estimated values of water collected on the wall surfaces of the intake ports. The values of the estimated wet amounts W1, W2 are calculated in step S360, which will be discussed below. In step S310, the ECM 20 determines whether an estimated wet amount WH of the intake port in which the asynchronous injection was executed as the latest injection is greater than or equal to a specified threshold WMAX.

When the estimated wet amount WH is less than the threshold WMAX (S310: NO), the ECM 20 commands, in step S320, the water injection valve that executed the synchronous injection as the latest injection to execute the synchronous injection with an amount equal to the synchronous injection amount command value QD. In the following step S330, the ECM 20 commands the water injection valve that executed the asynchronous injection as the latest injection to execute the asynchronous injection with an amount equal to the asynchronous injection amount command value QH. That is, the ECM 20 commands each of the water injection valves to execute the same one of the synchronous injection or the asynchronous injection that that water injection valve executed as the latest injection. Thereafter, the ECM 20 advances the process to step S360.

When the estimated wet amount WH is greater than or equal to the threshold WMAX (S310: YES), the ECM 20 commands, in step S340, the water injection valve that executed the asynchronous injection as the latest injection to execute the synchronous injection with an amount equal to the synchronous injection amount command value QD. In the following step S350, the ECM 20 commands the water injection valve that executed the synchronous injection as the latest injection to execute the asynchronous injection with an amount equal to the asynchronous injection amount command value QH. That is, the ECM 20 switches between the water-injection valve that executes the synchronous injection and the water-injection valve that execute asynchronous injection. Thereafter, the ECM 20 advances the process to step S360.

When advancing the process to step S360, ECM 20 updates the values of the estimated wet amounts W1, W2. After the process of step S360, the ECM 20 ends the process of the water injection control routine in the current control cycle. In the present embodiment, the processes of steps S310 to S350 in the water injection control routine in FIG. 5 correspond to the switching process, and the process of step S360 correspond to an estimation process.

<Estimation of Amount of Water Collected on Wall Surfaces of Intake Ports>

In the present embodiment, the amount of water collecting on the wall surface of each of the first intake port 16 and the second intake port 17 is estimated by updating the values of the estimated wet amounts W1, W2 in step S360 of FIG. 5. Next, such estimation of the collected water amount will be described.

When updating the values of the estimated wet amounts W1, W2, the ECM 20 calculates a newly collected amount A1 at the first intake port 16 and a newly collected amount A2 at the second intake port 17. The newly collected amounts A1, A2 represent the amount of water newly collected on the wall surfaces of the intake ports during the period from the current control cycle to the next control cycle. The newly collected amounts A1, A2 increase as the amount of water injected into the corresponding intake port increases. In addition, the newly collected amounts A1, A2 are larger in the case of the asynchronous injection than in the case of the synchronous injection even if the water injection amount is the same. On the other hand, when the intake air flow rate is relatively high, the air flow promotes atomization of injected water. Therefore, the newly collected amounts A1, A2 are smaller when the intake air flow rate is relatively high than when the intake air flow rate is relatively low. Further, the newly collected amounts A1, A2 are larger when the temperature of the wall surfaces of the intake ports and/or the temperature of the intake air is relatively low than when the temperature is relatively high. Taking these factors into consideration, a physical model of water collected on the wall surfaces of the intake ports is created, and the ECM 20 calculates the newly collected amounts A1, A2 based on the water injection amount, the water injection timing, the intake air flow rate, the coolant temperature, the intake air temperature, and the like in accordance with the created physical model. The timing of water injection indicates whether the water injection is the synchronous injection or the asynchronous injection.

When updating the values of the estimated wet amounts W1, W2, the ECM 20 calculates an evaporation amount B1 at the first intake port 16 and an evaporation amount B2 at the second intake port 17. The evaporation amounts B1, B2 represent the amount of water evaporating from the wall surfaces of the intake ports during the period from the current control cycle to the next control cycle. The evaporation amounts B 1, B2 increase as the amount of water collected on the wall surface increases. When the intake air flow rate is relatively high, the air flow in the intake ports becomes strong. Therefore, the evaporation amounts B 1, B2 are larger when the intake air flow rate is relatively high than when the intake air flow rate is relatively low. The evaporation amounts B1, B2 are larger when the temperature of the wall surfaces of the intake ports and/or the temperature of intake air is relatively high than when the temperature is relatively low. Further, the period from the current control cycle to the next control cycle is shorter when the engine rotation speed is relatively high than when the engine rotation speed is relatively low. Accordingly, the evaporation amounts B 1, B2 during the same period decrease when the engine rotation speed is relatively high. Taking these factors into consideration, a physical model of the evaporation of water from the wall surfaces of the intake ports is created, and the ECM 20 calculates the evaporation amounts B1, B2 based on the estimated wet amounts W1, W2, the intake air flow rate, the coolant temperature, the intake air temperature, the engine rotation speed, and the like in accordance with the created physical model.

The ECM 20 obtains an updated value of the estimated wet amount W1 by adding the newly collected amount A1 to the pre-update value of the estimated wet amount A1 and subtracting the evaporation amount B1 from the resultant (W1 [updated]←W1 [pre-update]+A1−B1). Also, the ECM 20 obtains an updated value of the estimated wet amount W2 by adding the newly collected amount A2 to the pre-update value of the estimated wet amount W2 and subtracting the evaporation amount B2 from the resultant (W2 [updated]←W2 [pre-update]+A2−B2).

Operation and Advantages of Embodiment

The controller of the present embodiment switches the intake port in which the asynchronous injection is executed when the estimated wet amounts W1, W2 at the intake ports in which the asynchronous injection is executed exceed the threshold WMAX. This configuration prevents the asynchronous injection from being continued in the same intake port. The present embodiment thus achieves the same advantages as the first embodiment.

Depending on the operating state of the engine 10, both the estimated wet amount W1 of the first intake port 16 and the estimated wet amount W2 of the second intake port 17 may exceed the threshold WMAX. In such a case, the intake port in which the synchronous injection is executed and the intake port in which the asynchronous injection is executed are alternately switched for each injection.

Other Embodiments

The above-described embodiments may be modified as follows. The above-described embodiments and the following modifications can be combined if the combined modifications remain technically consistent with each other.

In the above-described embodiments, the asynchronous injection is executed by executing water injection during the exhaust stroke before the intake valves 15 are opened. However, the asynchronous injection may be executed after the intake valves 15 are closed, for example, during the compression stroke or the combustion stroke.

In the above-described embodiments, when the requested water injection amount QS exceeds the maximum synchronous injection amount QDL, the synchronous/asynchronous concurrent injection is executed. However, the synchronous/asynchronous concurrent injection may be executed under a condition different from this. Whether to execute the synchronous/asynchronous concurrent injection may be determined based on the engine rotation speed, the engine load, the intake air temperature, and/or the coolant temperature.

In the above-described embodiments, the intake port in which the asynchronous injection is executed is switched based on the number of times of executions of the asynchronous injection in the same intake port or the estimated wet amounts W1, W2. The intake port in which the asynchronous injection is executed may be switched based on a parameter other than the above, such as the injection amount of water by the asynchronous injection.

The water injection control of the above-described embodiments can be similarly employed in an engine in which three intake ports are connected to each cylinder 11. In this case, during the execution of the synchronous/asynchronous concurrent injection, the intake port in which the asynchronous injection is executed is sequentially switched among the three intake ports.

The controller is not limited to one including the ECM 20, which includes the processor 21 and the memory device 22. That is, the controller may be processing circuitry that has any one of the following configurations (a) to (c).

(a) Processing circuitry including one or more processors that execute various processes according to computer programs. The processor includes a CPU and a memory such as RAM and ROM. The memory stores program codes or instructions configured to cause the CPU to execute processes. The memory, which is a computer-readable medium, includes any type of media that are accessible by general-purpose computers and dedicated computers.

(b) Processing circuitry including one or more dedicated hardware circuits that execute various processes. The dedicated hardware circuits include, for example, an application specific integrated circuit (ASIC) and a field programmable gate array (FPGA).

(c) Processing circuitry including one or more processors that execute part of various processes according to programs and one or more dedicated hardware circuits that execute the remaining processes.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller for an engine, wherein the engine includes:

a cylinder;

intake ports connected to the cylinder;

intake valves that respectively correspond to the intake ports, each of the intake valves being configured to selectively allow for and block connection between the corresponding one of the intake ports and the cylinder; and water injection valves installed in the respective intake ports, each of the water injection valves being configured to inject water to the corresponding one of the intake ports, the controller comprises processing circuitry that is configured to selectively execute, for each of the intake ports, a synchronous injection that causes the corresponding one of the water injection valves to inject water only during a valve opening period of the corresponding one of the intake valves and an asynchronous injection that causes the corresponding one of the water injection valves to inject water during a valve closing period of the corresponding one of the intake valves, and the processing circuitry is configured to perform, when executing a synchronous/asynchronous concurrent injection in which the intake ports includes an intake port in which the synchronous injection is executed and an intake port in which the asynchronous injection is executed, a switching process of switching the intake port in which the asynchronous injection is executed.

2. The controller for the engine according to claim 1, wherein the switching process switches the intake port in which the asynchronous injection is executed each time water injection is executed.

3. The controller for the engine according to claim 1, wherein the switching process switches the intake port in which the asynchronous injection is executed each time a number of times of consecutive executions of the asynchronous injection in a same one of the intake ports reaches a specified number of times.

4. The controller for the engine according to claim 1, wherein the processing circuitry is configured to perform an estimation process that estimates a collected water amount on a wall surface of each of the intake ports, and the switching process switches the intake port in which the asynchronous injection is executed when an estimated value of the collected water amount at the intake port in which the asynchronous injection is executed becomes greater than or equal to a specified threshold.

5. The controller for the engine according to claim 1, wherein the processing circuitry is configured to calculate a requested water injection amount, the requested water injection amount being a requested value of a total water injection amount that is a sum of water injection amounts for the respective intake ports, calculate a maximum synchronous injection amount, the maximum synchronous injection amount being a maximum value of the total water injection amount that is obtained when the synchronous injection is executed in all the intake ports, execute the synchronous injection in all the intake ports when the requested water injection amount is less than or equal to the maximum synchronous injection amount, and execute the synchronous/asynchronous concurrent injection when the requested water injection amount exceeds the maximum synchronous injection amount.

6. The controller for the engine according to claim 5, wherein the processing circuitry is configured to set, when executing the synchronous/asynchronous concurrent injection, a water injection amount to the intake port in which the synchronous injection is executed to a maximum value of an amount of water that can be injected to the intake port by the synchronous injection.

7. A method for controlling an engine, wherein the engine includes:

a cylinder;

intake ports connected to the cylinder;

intake valves that respectively correspond to the intake ports, each of the intake valves being configured to selectively allow for and block connection between the corresponding one of the intake ports and the cylinder; and water injection valves installed in the respective intake ports, each of the water injection valves being configured to inject water to the corresponding one of the intake ports, the method comprises:

selectively executing, for each of the intake ports, a synchronous injection that causes the corresponding one of the water injection valves to inject water only during a valve opening period of the corresponding one of the intake valves and an asynchronous injection that causes the corresponding one of the water injection valves to inject water during a valve closing period of the corresponding one of the intake valves;

executing a synchronous/asynchronous concurrent injection in which the intake ports includes an intake port in which the synchronous injection is executed and an intake port in which the asynchronous injection is executed; and when executing the synchronous/asynchronous concurrent injection, executing a switching process of switching the intake port in which the asynchronous injection is executed.

* * * * *